US007724202B2

(12) United States Patent
Mayes et al.

(10) Patent No.: US 7,724,202 B2
(45) Date of Patent: May 25, 2010

(54) TRANSITION FROM A PULSE GENERATOR TO ONE OR MORE HELICAL ANTENNAE

(76) Inventors: Jonathan R. Mayes, P.O. Box 341149, Austin, TX (US) 78734; Mark G. Mayes, 3601 Bayton Dr., Austin, TX (US) 78738

( * ) Notice: Subject to any disclaimer, the term of this patent is extended or adjusted under 35 U.S.C. 154(b) by 217 days.

(21) Appl. No.: 12/217,378

(22) Filed: Jul. 3, 2008

(65) Prior Publication Data

US 2009/0027295 A1 Jan. 29, 2009

Related U.S. Application Data

(60) Provisional application No. 60/958,211, filed on Jul. 3, 2007.

(51) Int. Cl.
*H01Q 1/50* (2006.01)

(52) U.S. Cl. ..... 343/859; 343/850; 333/26; 333/33; 333/245; 333/260

(58) Field of Classification Search ..... 343/850, 343/859, 895; 333/26, 33, 245, 260
See application file for complete search history.

(56) References Cited

U.S. PATENT DOCUMENTS 3,569,979 A * 3/1971 Munk et al. ..... 343/895
3,735,188 A * 5/1973 Anderson et al. ..... 315/3.5

* cited by examiner

*Primary Examiner*—Hoang V Nguyen
(74) *Attorney, Agent, or Firm*—David Allen Hall

(57) ABSTRACT

An apparatus providing a low impedance transition from a pulse generator to one or more helical antennae. Conventional transition from coaxial-to-antenna causes energy loss. The present invention decreases that loss.

7 Claims, 4 Drawing Sheets

TRANSITION FROM A PULSE GENERATOR TO ONE OR MORE HELICAL ANTENNAE

This application claims priority from provisional application No. 60/958,211 filed Jul. 3, 2007.

This invention was made with Government support under FA9451-07-C-0009 awarded by the United States Air Force. The Government has certain rights in the invention.

FIELD OF THE INVENTION

The present invention pertains to the fields of electronic pulse generation and antennae.

BACKGROUND OF THE INVENTION

In 2001, Mayes et al. described a high voltage Marx generator sourcing a helical antenna. "The Marx Generator as an Ultra Wideband Source," J. R. Mayes, W. J. Carey, W. C. Nunnally, and L. Altgilbers, 13th IEEE International Pulsed Power Conference, 2001. While the helical antenna is traditionally a resonant device, the paper described what is now described as an impulse excitation, or shock-exciting-antenna structure, such that the structure rings with several cycles at a frequency defined by the antenna geometry. The paper described a Marx generator capable of delivering 125 kV, sourcing a helical antenna designed for a resonant frequency of 1 GHz. The paper concluded its discussion of the Marx-helical device with a measured waveform and calculated spectral response. The radiated electric field was witnessed to be less than expected. The electric field strength was measured to be only approximately 300 V/m, measured at 100 m, as shown in FIG. 2(*a*). However, the spectral response, shown in FIG. 2(*b*) was as expected, with a center frequency of 1 GHz.

Shock excitation of a resonant structure results in a brief voltage ring, producing several cycles of energy that are radiated by the structure. This is an inefficient method for producing wideband energy because the driving pulsed power produces an Ultra Wide Band spectrum of energy, as shown in FIG. 3(*a*). The helical antenna can be viewed as a bandpass filter in which the structure radiates, or passes energy, at a center frequency, as well as energy located in frequencies near and around the center frequency; thus acting as a wide band filter as illustrated in FIG. 3(*b*). Energy not radiated by the antenna is either recaptured by the source or, in the case of a Marx generator-fed system, the energy is dissipated via heat.

A better description of the shock-excited helical antenna, however, is one in which the physical parameters, including the stray capacitance and inductance, are pulse-excited with a voltage. The relaxation of these parameters occurs at the antenna's natural resonant frequency. Thus the radiation from the helical antenna manifests as an impulse response, and, with extremely high impulse voltages, the radiated electric field can be high.

Analysis of the initial effort showed that the primary cause of the inefficiency in the peak electric field strength was the transition section between the Marx generator and the helical antenna, as well as the initial geometry of the helical antenna. In the initial demonstration a coaxial section interconnected the Marx generator to the input of the helical antenna, as suggested by J. D. Kraus. John D. Kraus, *Antennae,* $2^{nd}$ edition, McGraw-Hill Inc., 1988. As shown in FIG. 4, the helical antenna conductor immediately begins its spiral path from the coaxial geometry of the feed structure. This abrupt transition from a coaxial geometry to the coil geometry results in a high inductance that produces an excessive impedance mismatch, as well as an enhancement point that results in a corona emission with high voltages and ultimately results in the failure of the antenna.

SUMMARY OF THE INVENTION

The present invention is a significantly improved transition from a coaxial geometry to one or more helical antenna geometries, and concentric helical antennae designed to radiate simultaneous energy with multiple center frequencies.

While the helical antenna is a practical device for radiating RF energy, it is especially appealing for radiating high power RF from 100 MHz to several GHz. It is noted that the geometry described by FIG. 1 leads to RF radiation in a portion of the spectrum difficult to attain. There currently are not any methods for generating high voltage, high power RF in the spectral range from 400 MHz to 1 GHz, other than with Ultra Wide Band. The arrangement of FIG. 1 allows for the generation of wide band radiation within the 400 MHz to 1 GHz range with bandwidths of 15-20%.

BRIEF DESCRIPTION OF THE DRAWINGS

FIG. 2(*b*) shows the frequency spectrum of the waveform of FIG. 2(*a*).

FIG. 3(*b*) shows the output of a helical antenna driven by a Marx generator.

FIG. 5(*b*) is a cross-sectional view of the transition of FIG. 5(*a*).

DETAILED DESCRIPTION OF THE PREFERRED EMBODIMENT

The structure and operation of the invention will become apparent upon reading the following detailed description of the preferred embodiment and upon reference to the accompanying drawings. The inventors present herein the best mode for carrying out the present invention in terms of its preferred embodiment, depicted within the aforementioned drawings.

Figure 1:
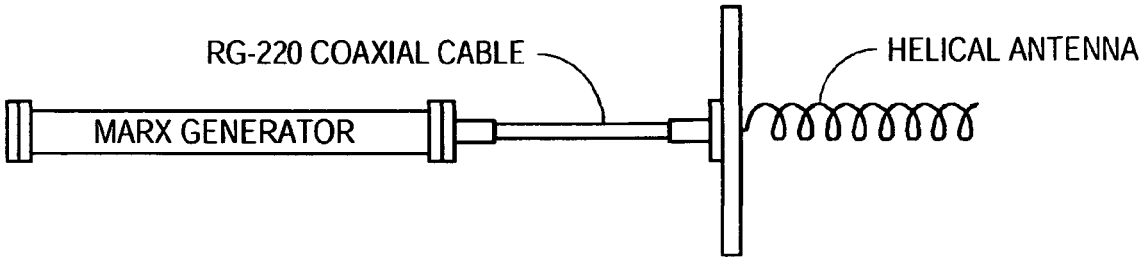
FIG. 1 is a schematic of the typical hardware of a pulse generator driving a helical antenna.
Figure 2A:
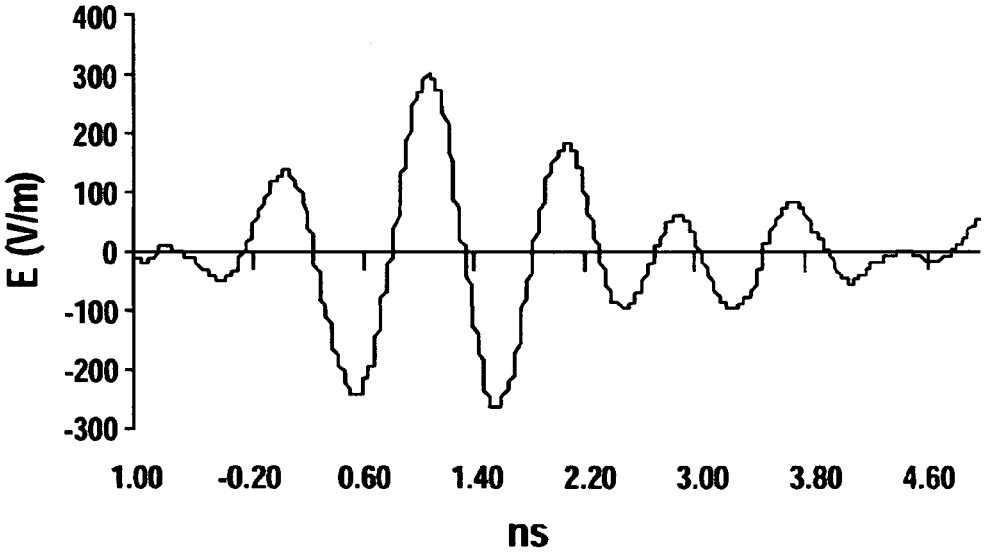
FIG. 2(*a*) shows a sample voltage waveform from a Marx generator.
Figure 2B:
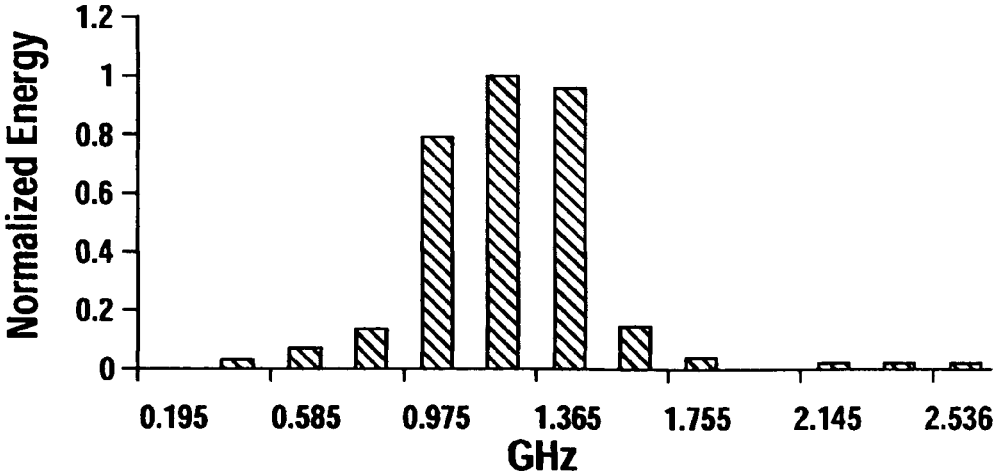
Figure 3A:
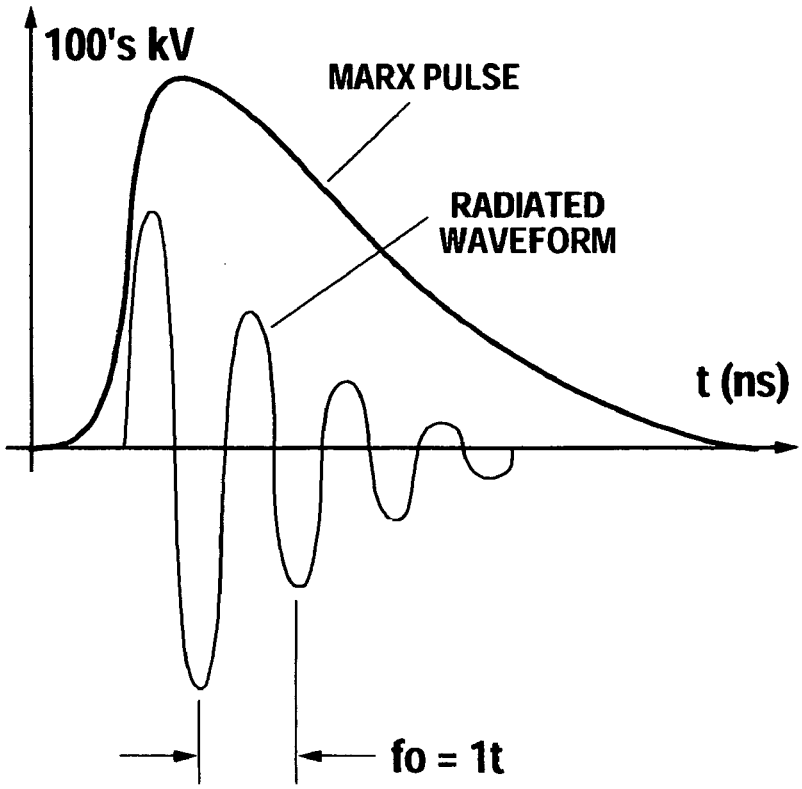
FIG. 3(*a*) shows a Marx generator output.
Figure 3B:
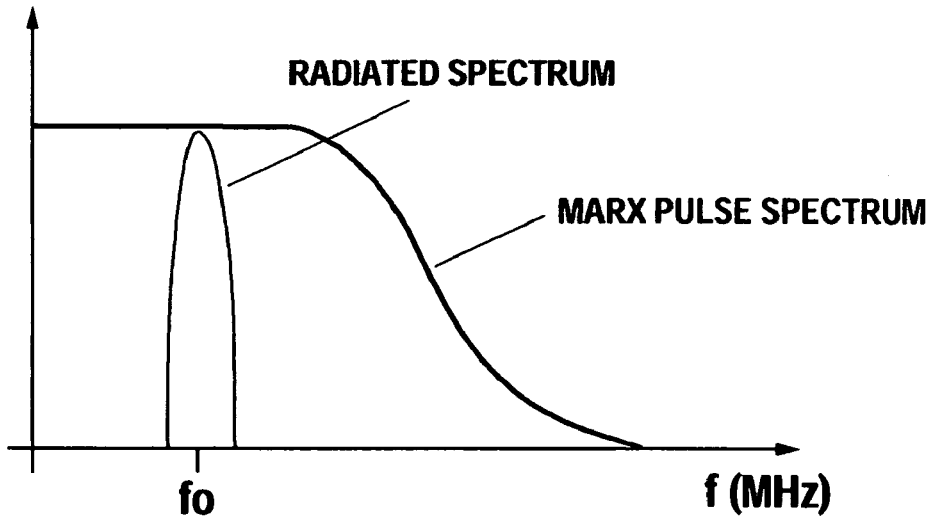
Figure 4:
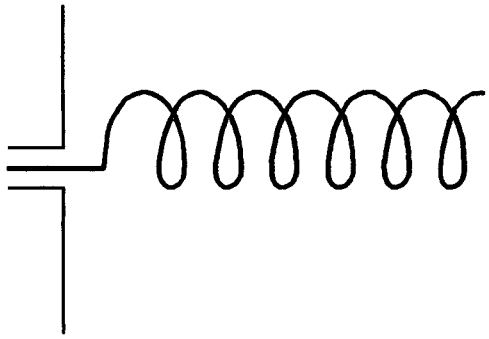
FIG. 4 is a schematic of the transition between a pulse generator and a helical antenna.
Figure 5A:
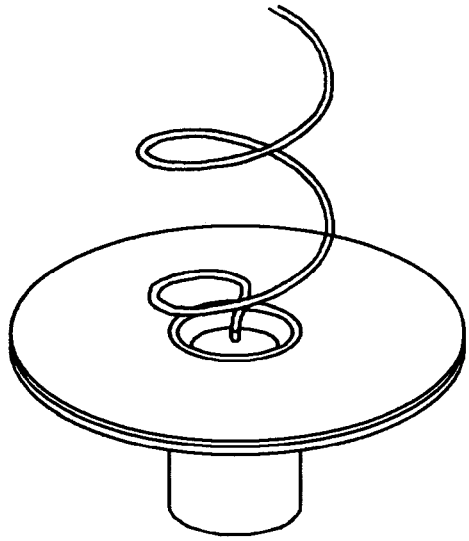
FIG. 5(*a*) is a perspective drawing of a transition from coax to a helical antenna employing a solid dielectric transition to air.
Figure 5B:
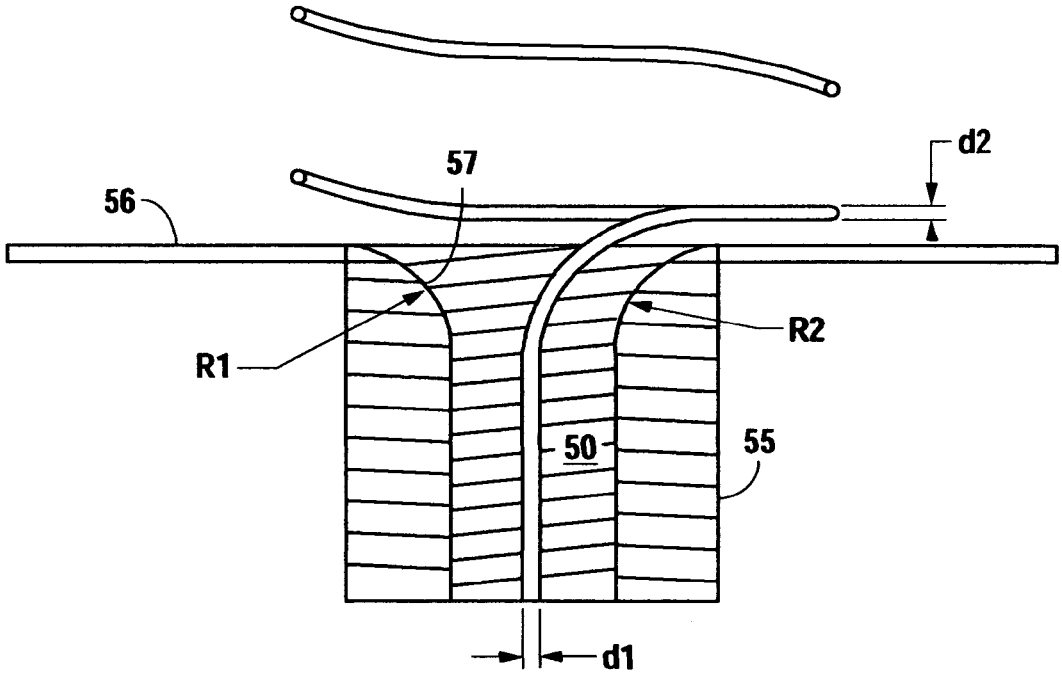

The present invention transition evolves the coaxial feed geometry to the helical antenna geometry. This section evolves from a coaxial geometry, such as a coaxial cable or the output of a pulse generator having a coaxial output, to the helical geometry, which begins as a conductor above a flat ground plane, while maintaining substantially constant impedance. The fundamental preferred geometry is shown in FIGS. 5(*a*) and 5(*b*). The outer conductor consists of a tube 55 mated to a flat plate 56 preferred by the helical antenna. The transition curve 57 from the tubular geometry 55 to the flat plate geometry 56 is made with a radius R1 much less than the wavelength of the helical antenna, but large enough to reduce edges prone to corona emissions, as well as to avoid a voltage breakdown between the conductors. The center conductor is typically cylindrical, with a diameter d1 to meet the predetermined characteristic impedance of a preferred coaxial transmission line. Once this conductor has transitioned to the flat ground plane, its diameter may be changed to a different diameter d2 to meet the designed impedance for a conductor over a flat ground plane, while maintaining enough distance between the conductor and the flat ground plane to avoid a voltage breakdown. Radii R1 and R2 are sized for maintenance of the desired impedance through the transition as the inner conductor begins to curve toward the exterior of the outer conductor and assume its conductor above ground plane geometry. The center conductor diameter continues to vary as it follows the radius joining the coaxial section with the flat plate. As the center conductor begins to diverge from the coaxial geometry, it begins the helix geometry of the helical antenna. For this preferred geometry, a single dielectric material is used.

In FIG. 5(*b*) the coaxial section is filled with an insulating solid dielectric 50. The fundamental geometry may be varied to include a variety of materials, including solids, liquids and gases, or any combination of these materials. However, it is of paramount importance that as the geometry moves from one material to the next, a constant impedance should be maintained, and shifts in modal energy should not be made.

Design of the multi-helical geometry must account for the multiple and parallel impedances created by the multiple helical conductors. The bend radii of the transition assumes the wavelength of the smallest helical, and this transitional section should match the impedance realized by the parallel helices.

Figure 6:
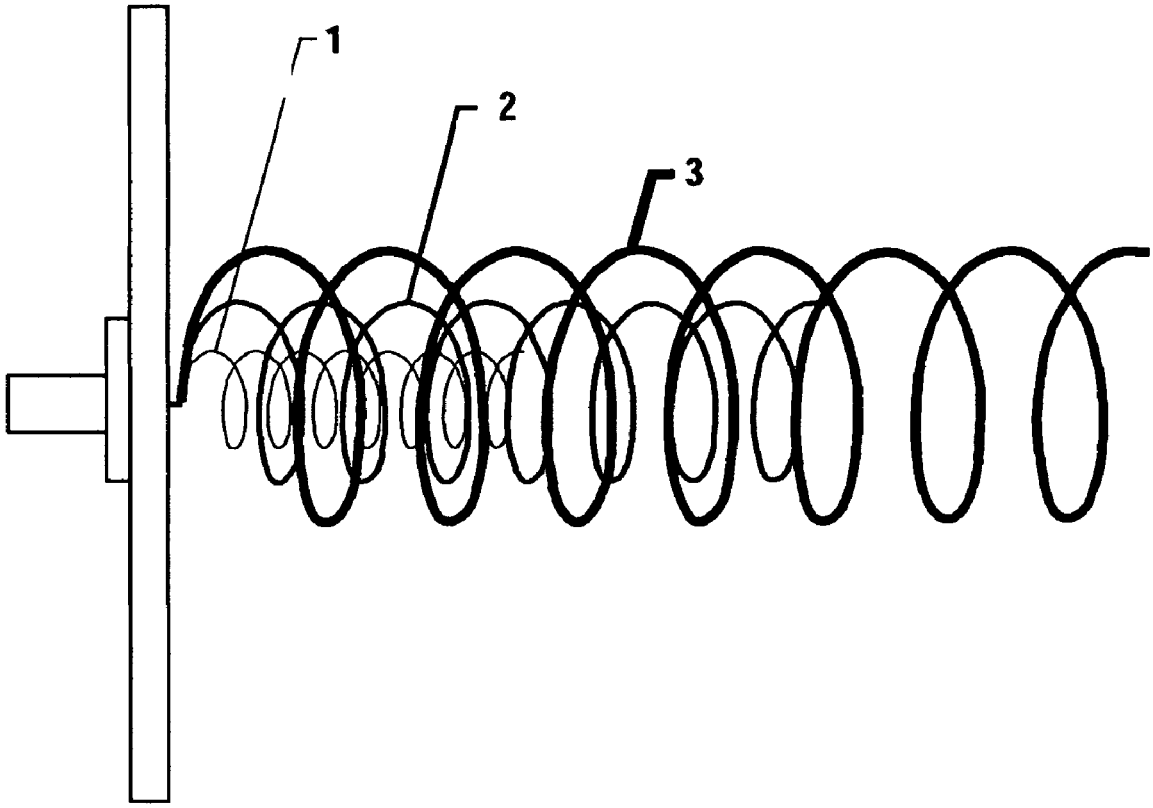
FIG. 6 illustrates a multi-coiled helical antenna capable of radiating multiple center frequencies.

A second embodiment is illustrated in FIG. 6 as a method for generating RF energy with multiple center frequencies via concentric helical antennae, each having a unique diameter (1, 2, and 3). To enable this design, the transition section previously described must include multiple output lines that transition into multiple coils describing the individual helical antennae. In essence, the coaxial section might be comprised of a single center conductor, but as the conductor begins to transition toward the helical geometry, the conductor must split into additional conductors, one each per helical antenna. This split may occur within the coaxial section, or after the single conductor has begun propagating above the helical ground plane.

It will be apparent to those with ordinary skill in the relevant art having the benefit of this disclosure that the present invention provides an apparatus for matching the impedance between a pulse generator and one or more helical antennae. It is understood that the form of the invention shown and described in the detailed description and the drawings is to be taken merely as the presently preferred embodiment, and that the invention is limited only by the language of the claims. The drawings and detailed description presented herein are not intended to limit the invention to the particular embodiment disclosed. While the present invention has been described in terms of one preferred embodiment and a few variations thereof, it will be apparent to those skilled in the art that form and detail modifications can be made to those embodiments without departing from the spirit or scope of the invention.

We claim:

1. An apparatus for the transition of high voltage electrical energy from a coaxial geometry to one or more wire-above-smooth-ground-plane helix geometries comprising:

an electrically conducting tube attached to a flat plate, said attachment having a smooth radius; and an electrical conductor inside said tube, said conductor having a varying cross section that gradually becomes said helix geometry.

2. The apparatus of claim 1 further comprising a solid dielectric insulator.

3. The apparatus of claim 1 further comprising a gaseous dielectric insulator.

4. The apparatus of claim 1 further comprising a liquid dielectric insulator.

5. The apparatus of claim 1 further comprising a dielectric insulator made of a combination of substances.

6. The apparatus of claim 1 wherein the impedance of said coaxial geometry is based on a first relative permittivity and said impedance of said helix geometry is based on a second relative permittivity.

7. The apparatus of claim 1 wherein said transition includes a section of capacitance higher than that of said coaxial geometry and a section of constant impedance that facilitates a resonance condition preferred by said helix geometry.

* * * * *